US005285758A

United States Patent [19]

Fiedler et al.

[11] Patent Number: 5,285,758

[45] Date of Patent: Feb. 15, 1994

[54] FUEL INJECTION PUMP FOR INTERNAL COMBUSTION ENGINES

[75] Inventors: Rolf-Gerhard Fiedler, Nuertingen; Reiner Kuenzel, Herrenberg; Helmut Tschoeke, Ostfildern; Mohammad-Ali Khosrawi, Ludwigsburg, all of Fed. Rep. of Germany

[73] Assignee: Robert Bosch GmbH, Stuttgart, Fed. Rep. of Germany

[21] Appl. No.: 974,634

[22] Filed: Nov. 12, 1992

[30] Foreign Application Priority Data

Nov. 12, 1991 [DE] Fed. Rep. of Germany ..... 4137073

[51] Int. Cl.[5] ..... F02M 37/04

[52] U.S. Cl. ..... 123/495; 123/501; 123/449; 417/499

[58] Field of Search ..... 123/495, 449, 500, 501; 417/499, 494, 454, 490

[56] References Cited

U.S. PATENT DOCUMENTS

| | | | |
|---|---|---|---|
| 2,935,061 | 5/1960 | Voit | 123/449 |
| 3,129,702 | 4/1964 | Arbanas | 123/495 |
| 3,624,823 | 11/1971 | Staudt | 417/454 |
| 3,999,529 | 12/1976 | Davis | 123/500 |
| 4,094,201 | 6/1978 | Eheim | 123/449 |
| 4,505,247 | 3/1985 | Nierga | 123/495 |
| 4,625,700 | 12/1986 | Elsbett | 123/501 |
| 4,705,005 | 11/1987 | Guntert | 123/500 |
| 5,138,997 | 8/1992 | Fiehlmann | 123/495 |

FOREIGN PATENT DOCUMENTS

| | | | |
|---|---|---|---|
| 0018354 | 10/1980 | European Pat. Off. | 417/499 |
| 1103686 | 3/1961 | Fed. Rep. of Germany | 123/449 |
| 3507014 | 8/1986 | Fed. Rep. of Germany | 123/449 |

OTHER PUBLICATIONS

Distributor Fuel Injection Pump, Type VE, First Edition Jul. 1983, (VDT-U-2/2de), p. 5.

*Primary Examiner*—Carl S. Miller

*Attorney, Agent, or Firm*—Edwin E. Greigg; Ronald E. Greigg

[57] ABSTRACT

A fuel injection pump for internal combustion engines having a cup-shaped pump housing and a pump head enclosing the housing. The pump head has a cylinder in which a pump piston, which is set into simultaneous reciprocating and rotary motion by a cam drive, in the course of which it simultaneously acts as a distributor, encloses a pump work chamber that is filled with fuel upon an intake stroke and communicates with one of a plurality of injection lines upon the supply stroke. The resultant reaction forces and moments are supported according to the invention via a roller race supported directly on the pump head, and as a result the induction of force to the pump housing can be avoided.

20 Claims, 2 Drawing Sheets

FUEL INJECTION PUMP FOR INTERNAL COMBUSTION ENGINES

BACKGROUND OF THE INVENTION

The invention is based on a fuel injection pump for an internal combustion engine.

One such pump is known from Bosch Technical Instruction "Verteilereinspritzpumpe Typ VE" [Distributor Fuel Injection Pump, Type VE], first edition, July 1983 (VDT-U-2/2De), page 5. This fuel injection pump has a cup-shaped aluminum housing and a high-pressure distributor head which at the same time forms a cap for the housing, to which it is screwed to close off the fuel injection pump. Via the distributor head fastening screws, the forces of reactions arising upon high-pressure production support of the drive moment, as well as those arising from acceleration and braking of the distributor piston and eccentric disk, are initiated into the housing. Because the housing is embodied as a cup-like construction, these forces can be supported only on the bottom of the cup. The roller race itself that guides the eccentric disk is supported on the housing bottom, via a support ring and an eccentric ring of the integrated fuel injection pump. This produces a longitudinal force load on the lateral housing wall. The attendant "pumping" of the housing, caused by the vibration of the housing wall, creates noise problems.

OBJECT AND SUMMARY OF THE INVENTION

It is therefore an object of the invention to overcome the above-described disadvantages.

The fuel injection pump according to the invention has an advantage over the prior art in that all the reaction forces are supported directly on the distributor head. The distribution of the roller ring, which is supported neither on the housing bottom nor on the housing walls but rather on the pump head, the power force path is closed directly between the roller race and the pump head and the housing is removed from the power force. The reaction forces can accordingly be kept away from the high-pressure generation by the housing. In addition, the free forces of mass from the acceleration occurring during operation, and the forces for supporting the drive torque, can be kept away from the housing, because the entire high-pressure part is embodied as a separate part surrounded by the fuel injection pump housing and connected directly to an external holder. The housing is thus decoupled as much as possible from the high-pressure part. This structure with an inner, closed force circuit makes it possible to avoid the undesirable induction of force to the housing and the attendant vibration, which in turn means a noise reduction.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
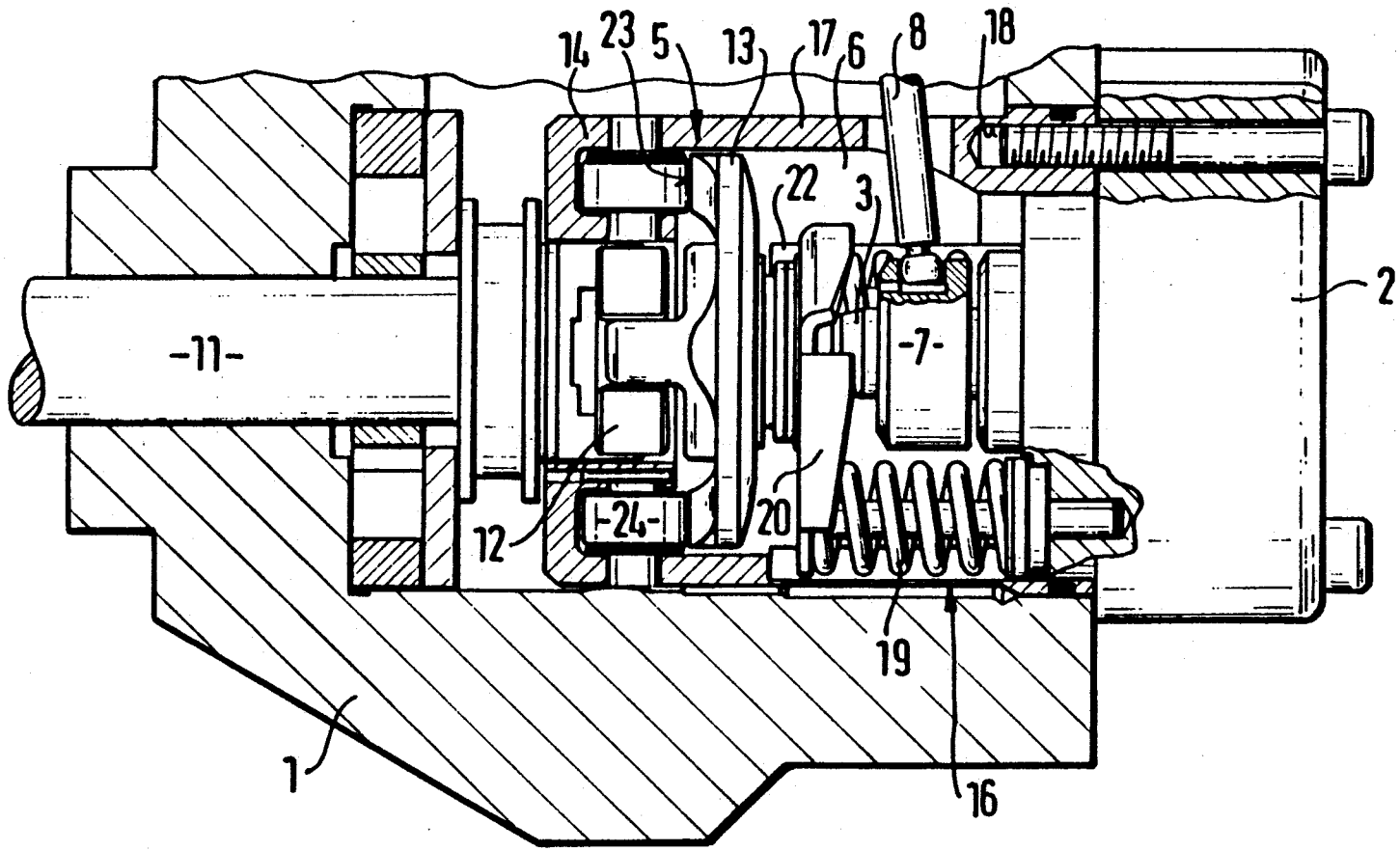
FIG. 1 shows a first exemplary embodiment, in which the roller race cage is firmly screwed to the pump head via axial bores.

In the fuel injection pump shown in FIG. 1, in which only the components necessary to describe the subject of the invention are shown, a pump piston 3 is set into axially reciprocating and simultaneously rotating motion by a cam drive 5 in a cup-shaped housing 1 which is closed by a pump head 2 adjacent to it and has a pump cylinder 4, not shown here; the pump piston is guided in the pump cylinder 4 and in it encloses a pump work chamber, likewise not shown. During the intake stroke of the pump piston 3, which is in the direction of the cam drive 5, fuel is pumped out of a suction chamber 6 in the interior of the pump housing 1 via longitudinal and transverse bores, not shown, in the pump piston 3 into the pump work chamber; then, during the supply stroke, this fuel is pumped to the engine via the bores extending in the pump piston 3, a distributor groove, and pressure conduits, which are likewise not shown. To control this pumping, an annular slide 7 is disposed on the pump piston 3 such that it can be axially displaced by an adjusting lever 8; depending on its position, it closes connecting conduits, not shown, between the pump work chamber and the suction chamber 6 and thus controls the injection quantity. The drive of the fuel injection pump is effected via a drive shaft 11, which is driven by the engine and protrudes into the pump housing on the side remote from the pump head 2 and is supported there. This drive shaft 11 is joined via a cross coupling 12 to an eccentric cam disk 13 of the cam drive 5. The cam disk 13 rolls on rollers 24 supported in a roller race 14, and the number of cams matches the number of cylinders of the engine to be supplied.

In the first exemplary embodiment this roller race 14 according to the invention, which will be called a roller ring cage 16 hereinafter, has a cylindrical extension 17, whose end rests on the pump head and is screwed together with it by screws via axial bores 18. The pump piston 3 is connected to the eccentric cam disk 13 in a manner secured against relative rotation, and by restoring springs 19 supported on the pump head 2, via a spring plate 20 and an axial bearing 22, the pump piston is pressed positively against the eccentric cam disk 13, which as a result is held positively by its running surface 23 on the rollers of the roller race cage 16.

Speed governing is done via a speed governor, not shown in further detail, which is joined to the drive shaft 11, or acts upon the annular slide 7 via a governor unit (such as an electromagnetic positioner) separate from the drive shaft and via the governor lever 8. The adjustment of injection onset, in this exemplary embodiment, in which there is a rigid connection between the pump head 2 and the roller race cage 16, is achieved via electrically controlled magnet valves, not shown, in the relief conduit of the pump work chamber. For fuel injection pumps with mechanical injection adjustment, contrarily, a rotation of the roller ring cage 16 is necessary.

Figure 2:
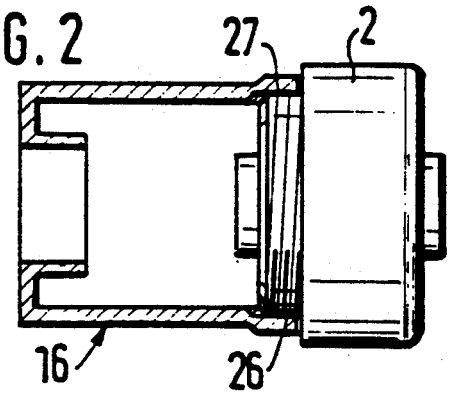
FIG. 2 shows an exemplary embodiment in which the roller race cage is screwed to the pump head via a female thread.

FIG. 2 shows a first way of achieving this. The roller race cage 16 in this second exemplary embodiment is screwed like a union nut onto a diameter reduction 27 of the pump head 2 via a female thread 26 in the cylindrical extension 17. However, the two parts are not tightened or locked firmly against one another, since the option of relative rotation of the roller race cage 16 and hence of the location of the rollers 24 relative to the pump head 2 must be preserved for the sake of injection adjustment, and this is effected via the thread 26.

Figure 3:
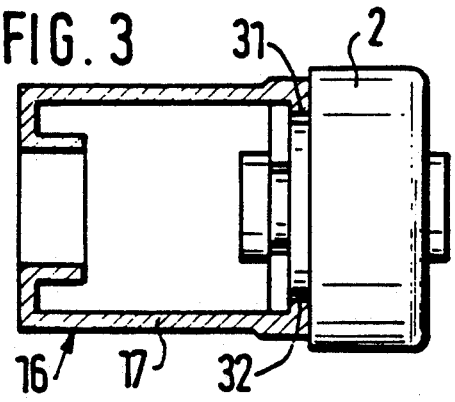
FIG. 3 is an exemplary embodiment in which the roller race cage is joined to the pump head in the manner of a bayonet mount.

A relative axial change in position of the roller race cage 16 that occurs in FIG. 2 upon an injection adjustment, and thus an influence on the injection pump or the course of injection, can be avoided if in the embodiment of FIG. 3 the connection between the roller race cage 16 and the pump head 2 is embodied as a kind of bayonet mount.

Figure 4:
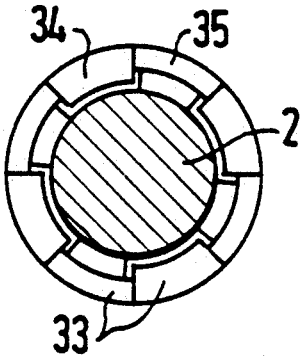
FIGS. 4 and 5 are cross sections through the variant embodiment shown in FIG. 3, in which the structure of the bayonet mount is shown.
Figure 5:
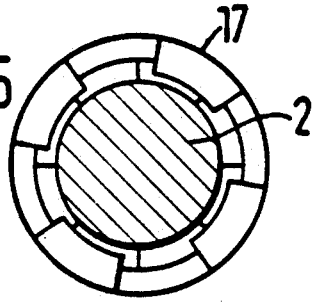

To explain the structure and function of this bayonet mount, FIGS. 4 and 5 show the third exemplary embodiment in cross section; FIG. 4 shows the introduction of the two parts, and FIG. 5 shows the production of the form-fitting connection by rotating the parts relative to one another.

A rib 31 at the end of the cylindrical extension 17 of the roller race cage 16, and a groove 32 on the pump head 2 adapted to it, provide the guidance in the manner of a bayonet mount, and the capability of axial installation is assured via segmental recesses 33 in the rib 31 of the roller race cage 16 and of the groove 32 of the pump head 2. The form-fitting connection of the radially inwardly protruding retaining parts 34 on the roller race cage 16 and of the radially outwardly protruding retaining elements 35 on the pump head 2 is effected after they are put together, by rotation about an angle $\alpha$ (FIG. 4) of the parts 34, 35 relative to one another. This angle $\alpha$ of rotation must be larger than the maximum rotation of the roller race cage in the injection adjustment, to avoid unintended loosening of the bayonet mount.

Figure 6:
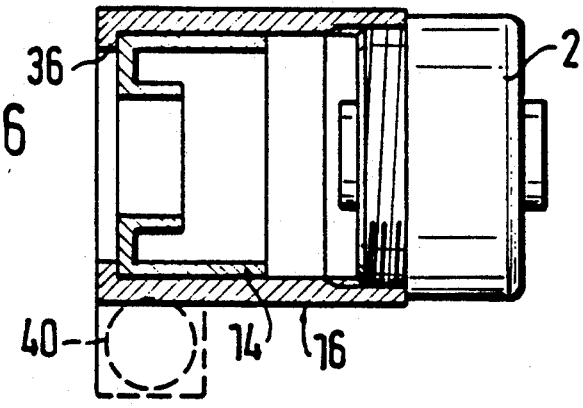
FIG. 6 shows a further exemplary embodiment, in which the roller race cage is rotatably supported and receives an injection on said adjuster.

However, these adaptations with respect to the relative rotation of the roller race cage 16 and pump head 2 are not necessary if, in accordance with the fourth exemplary embodiment, an injection adjuster 40 is integrated with the roller race cage 16, as FIG. 6 shows.

In addition to the structure described in conjunction with FIG. 2, a roller race 14 is also rotatably supported in the roller race cage 16 joined to the pump head 2. The roller race cage 16 serves nearly as a guide sleeve with an axial stop. To that end, analogously to FIG. 2, it is screwed like a union nut onto the pump head 2 and has an inwardly protruding rib 36 on its end remote from the pump head 2; this rib serves as an axial stop, in the direction remote from the pump head 2, for the roller race 14 rotatably supported in the interior of the roller race cage 16, against which stock the rib is pressed by the restoring springs 19, not shown here. This makes it possible, for the injection adjuster 40, which is firmly disposed on the roller race cage 16 joined rigidly to the pump head 2 and which may also be embodied as a control motor, to be made to act upon the rotatable roller race 14 inside the roller race 16, via a longitudinal groove, not shown, in the roller race cage 16, for the sake of adjusting the injection onset.

Figure 7:
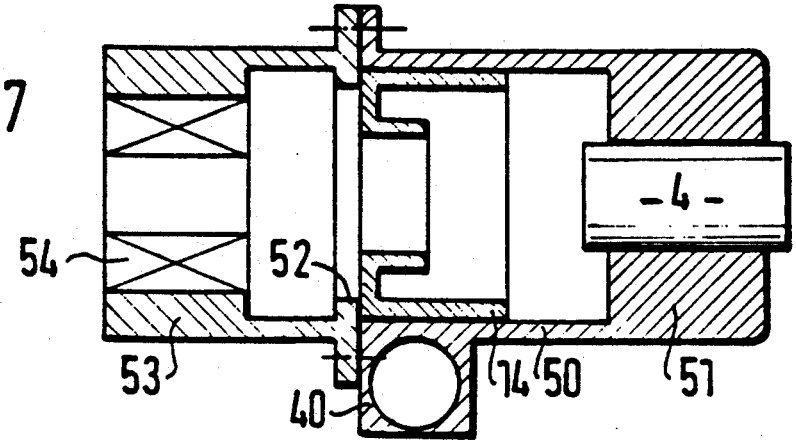
FIG. 7 shows an exemplary embodiment in which the pump head is embodied as a carrier that receives the roller race in an axial recess, and which on its axial end wall adjoins a cap part that guides the drive shaft.

A further exemplary embodiment is shown in FIG. 7, in which the simplified roller race cage 16 and the pump head 2 are made in one piece. This carrier 50 created from the roller race cage 16 of the pump head 2 has a cylindrical cup shape, in whose closed cap part 51 the pump cylinder 4 again serving to receive and guide the pump piston 3 is disposed, and in whose circumference the injection adjuster 40 is integrated; analogously to FIG. 6, this injection adjuster acts via a longitudinal groove in the carrier 50 upon the roller race 14 rotatably supported in the interior of the carrier 50. This roller race 14 is pressed against a stop 52 by the restoring springs 19, the stop being formed by a cap 53 screwed to the open end of the cup-shaped carrier 50; the drive shaft 11, not shown here, which is guided via a bearing 54 in the cap 53, protrudes into this cap 53. The capability also exists of embodying the entire bearing 54 of the drive shaft 11 of the fuel injection pump as a closure cap 53 for the carrier 50 formed of the roller race cage 16 and pump head 2, in which case all the parts located in the power flux would be combined. If that unit is then externally joined directly to a stable holder, than in this way the surrounding pump housing 1 can be completely separated from the power flux, which in the final analysis approaches an encapsulation of the entire pump unit.

The fuel injection pump according to the invention functions as follows:

If the drive shaft 11 is driven at an rpm synchronized with the engine, then via the cross coupling 12, the eccentric cam disk 13 is driven as well, so that its running surface 23 rolls on the rollers 24 of the roller race 14, causing it to execute a reciprocating motion in the axial direction. The pump piston 3, positively joined to the eccentric cam disk 13, is likewise set into rotary and simultaneously reciprocating motion, and during the axial motion in the direction of the drive shaft 11 caused by the restoring springs 19, fuel flows out of the suction chamber, via a connecting conduit in the pump piston 3, into the pump work chamber; during the supply stroke of the pump piston 3 in the direction of the pump head 2, in which the connecting conduit between the suction chamber 6 and the pump work chamber is closed by the annular slide 7, this fuel is compressed, and via a distributor groove on the circumference of the pump piston, fuel is carried to the applicable injection line, by way of which the fuel is injected via an injection nozzle into the applicable cylinder of the engine to be supplied. As the piston stroke continues, this high-pressure pumping is ended by the opening of the connecting conduit between the pump work chamber and the suction chamber 6 by the annular slide 7, whereupon the fuel, which is at high pressure, flows back into the suction chamber 6. The reaction forces and moments that occur in these processes are supported via the roller race 14 on the pump housing 1 in the known fuel injection pumps, resulting in vibration and hence in pronounced noise transmission. With the aid of the provisions described in conjunction with FIGS. 1 through 7, it is possible to achieve a noise abatement because of the avoidance of any vibration caused by the induction of force to the pump housing 1; an internal force path is built up, and the full functional capacity of the adjustment by an injection adjuster is preserved.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A fuel injection pump for internal combustion engines having a cup-shaped pump housing (1), a pump head (2) which closes said cup-shaped pump housing (1) said pump head has a pump cylinder (4) in which a pump piston (3), is set into simultaneously reciprocating and rotary motion by a cam drive (5), in the course of which said pump piston simultaneously acts as a distributor and encloses a pump work chamber, said work chamber upon an intake stroke of the pump piston (3) communicates with a fuel-filled suction chamber (6) formed in the interior of the fuel injection pump and upon the supply stroke of the pump piston (3) communicates with one of a plurality of fuel injection lines, wherein an eccentric cam disk (13) moved by a drive shaft (11) that protrudes into the suction chamber (6) acts as the cam drive (5), the pump piston (3) is held on the cam disk (13) via a restoring spring (19) supported on the pump head (2), said restoring spring simultaneously presses the eccentric cam disk (13) against a roller race (14) over which the cams of the eccentric cam disk (13) roll in their rotary motion, the roller race (14) is a cup-like part which receives the rollers (24) and which is joined to the pump head (2).

2. A fuel injection pump as defined by claim 1, in which the roller race (14), is embodied as a roller race cage (16) secured to the pump head (2), the roller race (14) encompasses the eccentric cam disk (13), the restoring spring (19) and the pump piston (3) and has passage way openings for fuel and control members.

3. A fuel injection pump as defined by claim 1, in which the roller race cage (16) is secured to the pump head (2) via a female thread (26) and is rotatable by an actuator for adjusting the fuel injection onset.

4. A fuel injection pump as defined by claim 2, in which the roller race cage (16) is secured to the pump head (2) via a female thread (26) and is rotatable by an actuator for adjusting the fuel injection onset.

5. A fuel injection pump as defined by claim 1, in which the roller race cage (16) is joined to the pump head (2) by a bayonet mount and is rotatable via an actuator for adjustment of the fuel injection onset.

6. A fuel injection pump as defined by claim 2, in which the roller race cage (16) is joined to the pump head (2) by a bayonet mount and is rotatable via an actuator for adjustment of the fuel injection onset.

7. A fuel injection pump as defined by claim 5, in which the roller race cage (16), on a side where it is connected to the pump head (2), has a plurality of retaining elements (34) that protrude radially inward from its circumferential wall, between said retaining elements, radially outwardly oriented corresponding retaining parts (35) on the pump head can be passed axially, and said retaining elements upon a rotation of the roller race cage (16) come to rest axially on the pump head axially behind the radial retaining parts (35).

8. A fuel injection pump as defined by claim 6, in which the roller race cage (16), on a side where it is connected to the pump head (2), has a plurality of retaining elements (34) that protrude radially inward from its circumferential wall, between said retaining elements, radially outwardly oriented corresponding retaining parts (35) on the pump head can be passed axially, and said retaining elements upon a rotation of the roller race cage (16) come to rest axially on the pump head axially behind the radial retaining parts (35).

9. A fuel injection pump as defined by claim 1, in which the roller race (14) is rotatably supported in a roller race cage (16), which is joined to the pump head (2) and with which an injection onset adjuster (40) is integrated.

10. A fuel injection pump as defined by claim 2, in which the roller race (14) is rotatably supported in a roller race cage (16), which is joined to the pump head (2) and with which an injection onset adjuster (40) is integrated.

11. A fuel injection pump as defined by claim 9, in which the injection onset adjuster (40) is embodied as a control motor, which is secured to the roller race cage (16) and is coupled to the roller race (14) via an actuator that protrudes radially through an opening on the roller race cage (16).

12. A fuel injection pump as defined by claim 10, in which the injection onset adjuster (40) is embodied as a control motor, which is secured to the roller race cage (16) and is coupled to the roller race (14) via an actuator that protrudes radially through an opening on the roller race cage (16).

13. A fuel injection pump as defined by claim 1, in which the pump head (2) is embodied as a carrier (50), having an axial cylindrical recess for receiving restoring springs (19), pump piston (3), eccentric cam disk (13) and roller race (14), which roller race is radially guided on the cylindrical wall of the recess, and having an adjoining cap part (53) secured to one face end of the cylindrical wall, on which said cap part, the roller race (14) is axially supported.

14. A fuel injection pump as defined by claim 2, in which the pump head (2) is embodied as a carrier (50), having an axial cylindrical recess for receiving restoring springs (19), pump piston (3), eccentric cam disk (13) and roller race (14), which roller race is radially guided on the cylindrical wall of the recess, and having an adjoining cap part (53) secured to one face end of the cylindrical wall, on which said cap part, the roller race (14) is axially supported.

15. A fuel injection pump as defined by claim 3, in which the pump head (2) is embodied as a carrier (50), having an axial cylindrical recess for receiving restoring springs (19), pump piston (3), eccentric cam disk (13) and roller race (14), which roller race is radially guided on the cylindrical wall of the recess, and having an adjoining cap part (53) secured to one face end of the cylindrical wall, on which said cap part, the roller race (14) is axially supported.

16. A fuel injection pump as defined by claim 13, in which at least one opening in the cylindrical wall is provided for the passage through it of fuel and of at least one adjusting element.

17. A fuel injection pump as defined by claim 13, in which the cap part (53) simultaneously has a bearing (54) of the drive shaft (11).

18. A fuel injection pump as defined by claim 16, in which the cap part (53) simultaneously has a bearing (54) of the drive shaft (11).

19. A fuel injection pump as defined by claim 17, in which a control motor (40) for controlling the roller race (14) is disposed on a recess in the pump head (2) embodied as a carrier (50).

20. A fuel injection pump as defined by claim 3, in which the course of injection is varied in a desired way, as a function of the injection adjustment position, by an axial change in position of the roller race cage (16).

* * * * *